US006821699B2

(12) United States Patent
Kondou et al.

(10) Patent No.: US 6,821,699 B2
(45) Date of Patent: Nov. 23, 2004

(54) TONER, IMAGE FORMING METHOD AND APPARATUS USING THE TONER, AND CONTAINER CONTAINING THE TONER

(75) Inventors: Tomio Kondou, Numazu (JP); Hachiro Tosaka, Suntou-gun (JP); Hitoshi Ueda, Fuji (JP); Tomiaki Ito, Tagata (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/253,491

(22) Filed: Sep. 25, 2002

(65) Prior Publication Data

US 2003/0118932 A1 Jun. 26, 2003

(30) Foreign Application Priority Data

Sep. 25, 2001 (JP) ..... 2001-290393

(51) Int. Cl.[7] ..... G03G 13/22

(52) U.S. Cl. ..... 430/109.2; 430/109.4; 430/111.4; 430/124

(58) Field of Search ..... 430/109.2, 109.4, 430/111.4, 124

(56) References Cited

U.S. PATENT DOCUMENTS

| | | | | |
|---|---|---|---|---|
| 4,762,763 | A | 8/1988 | Nomura et al. | |
| 5,124,224 | A | 6/1992 | Berkes et al. | |
| 5,164,774 | A | 11/1992 | Tomita et al. | |
| 5,260,159 | A | 11/1993 | Ohtani et al. | |
| 5,380,616 | A | 1/1995 | Aoki et al. | |
| 5,518,851 | A * | 5/1996 | Katagiri et al. | 430/109.1 |
| 5,519,316 | A | 5/1996 | Hagiwara et al. | |
| 5,527,657 | A | 6/1996 | Takeda et al. | |
| 5,882,832 | A | 3/1999 | Tosaka et al. | |
| 5,884,129 | A | 3/1999 | Ichimura et al. | |
| 6,004,715 | A | 12/1999 | Suzuki et al. | |
| 6,120,960 | A * | 9/2000 | Aoki et al. | 430/109.2 |
| 6,168,894 | B1 | 1/2001 | Aoki et al. | |
| 6,183,926 | B1 | 2/2001 | Kuroda et al. | |
| 6,258,502 | B1 | 7/2001 | Nakamura et al. | |
| 6,335,139 | B1 * | 1/2002 | Gambayashi et al. | 430/111.4 |
| 6,360,068 | B1 | 3/2002 | Kinoshita et al. | |
| 6,403,275 | B1 | 6/2002 | Kuramoto et al. | |
| 6,432,589 | B1 | 8/2002 | Uchinokura et al. | |
| 6,500,594 | B2 | 12/2002 | Hamano et al. | |
| 6,509,130 | B1 | 1/2003 | Semura et al. | |
| 2001/0006583 | A1 | 7/2001 | Tomita | |

FOREIGN PATENT DOCUMENTS

| | | |
|---|---|---|
| EP | 0 811 887 | 12/1997 |
| JP | 6-282102 | 10/1994 |
| JP | 9-190013 | 7/1997 |
| JP | 10-39539 | 2/1998 |
| JP | 2000-39794 | 2/2000 |
| JP | 2001-100456 | 4/2001 |
| JP | 2001-100459 | 4/2001 |

OTHER PUBLICATIONS

Patent Abstracts of Japan, JP 2001–215755, Aug. 10, 2001.
Derwent Publications, AN 2001–385437, JP 2001–117260, Apr. 27, 2001.
Patent Abstracts of Japan, JP 2001–312126, Nov. 9, 2001.

* cited by examiner

*Primary Examiner*—John L. Goodrow
(74) *Attorney, Agent, or Firm*—Oblon, Spivak, McClelland, Maier & Neustadt, P.C.

(57) ABSTRACT

A toner having a half melting temperature not greater than 115° C. has good fixability without filming, even in an image forming method using a non-contact fixing method; has good fixability and color reproducibility, even in an image forming method reproducing multi-colored images by combining two or more toner layers of different color; has good heat resistance without impairing fixability and color reproducibility; and produces high quality images without impairing fixability and color reproducibility.

13 Claims, 1 Drawing Sheet

TONER, IMAGE FORMING METHOD AND APPARATUS USING THE TONER, AND CONTAINER CONTAINING THE TONER

BACKGROUND OF THE INVENTION

1. Field of the Invention

The present invention relates to a toner, and more particularly, to a toner used for a non-contact heating fixation method.

2. Discussion of the Background

Fixing methods of powder toner used in an electrophotographic process include:

(1) an unheated fixing method using a pressure or a solvent;

(2) a non-contact heating fixation method that does not directly heat a toner image, such as an oven fixing method of feeding a heated air to a toner image bearer and a radiation fixing method of feeding a heat with light; and (3) a contact heating fixation method of feeding a heat and a pressure to a toner image at the same time with a heating roller.

Many copiers and printers using an electrophotographic process use the contact heating fixation method (3), typified by the heating roller fixing method in terms of heat efficiency. However, the heating roller fixing method is not suitable for producing a high-resolution image formed of dots because the toner layer is crushed when pressed upon application of heat. Also, the method is not suitable for fixing toner images on both sides of a receiving material at the same time.

Therefore, the non-contact heating fixation method (2) is mostly used in duplex printing or copying, or copying that produces high quality images at a high speed. However, the non-contact heating fixation method (2) does not press a toner image as the heating roller fixing method does, and has less fixability than the heating roller fixing method. This phenomenon occurs when the fixing temperature is decreased to produce a low gloss image. In addition, when used in an image forming method producing multi-colored images by combining two or more toner layers having different colors, the phenomenon is very noticeable, which is a serious problem. In addition, a serious problem also occurs in color reproducibility.

Japanese Laid-Open Patent Publications Nos. 6-282102, 9-190013, 10-39539, 2000-39794, 2001-100456 and 2001-100459, etc., disclose toners preferably used for the non-contact fixing method (2). However, fixability and color reproducibility of the toners are still unsatisfactory.

Japanese Laid-Open Patent Publication No. 6-282102 discloses a melted viscosity and fixability of a rheometer. However, the printing speed is low as 5 cm/sec (50 mm/sec) and the fixing temperature is 125° C., which is higher than that of the present invention as described below. In addition, the method of Laid-Open Patent Publication No. 6-282102 is still unsatisfactory in low gloss (low fixing temperature) printing and/or copying, high-speed printing and/or copying, duplex or combination of plural-color printing and/or copying.

Japanese Laid-Open Patent Publication No. 10-39539 discloses a rheometer, coverage of an additive and a gloss, although not disclosing fixability. This is also unsatisfactory in a field of an object of the present invention, as the above-described Japanese Laid-Open Patent Publication No. 6-282102 is. The conventional technologies disclosed in other publications are also unsatisfactory in a field of an object of the present invention, as Japanese Laid-Open Patent Publication No. 6-282102 is.

Because of these reasons, a need exists for a toner having good fixability even when used in an image forming method using a non-contact fixing method.

SUMMARY OF THE INVENTION

Accordingly, an object of the present invention is to provide a toner having good fixability, even in an image forming method using a non-contact fixing method.

Another object of the present invention is to provide a toner having good fixability without filming, even in an image forming method using a non-contact fixing method.

Yet another object of the present invention is to provide a toner having good fixability and color reproducibility, even in an image forming method of reproducing multi-colored images by combining two or more toner layers having different colors.

A further object of the present invention is to provide a toner having good heat resistance without impairing fixability and color reproducibility.

A still further object of the present invention is to provide a toner producing high quality images without impairing fixability and color reproducibility.

In addition, another object of the present invention is to provide an image forming method and an image forming apparatus using the toner, and a container containing the toner.

These and other objects of the present invention will become more readily apparent, and can be attained by a toner having a half melting temperature not greater than 115° C. when measured by a flow tester.

In addition, the toner preferably has a half melting temperature of from 90 to 115° C. when measured by a flow tester, a difference of the half melting temperature not greater than 10° C. when two or more toners having different colors are used, a glass transition point not less than 50° C. and a weight-average particle diameter not greater than 12 $\mu$m (micrometers).

Further, the toner preferably includes a polyester resin or an epoxy resin as a binder resin.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and in which.

DETAILED DESCRIPTION OF THE PREFERRED EMBODIMENTS

Figure 1:
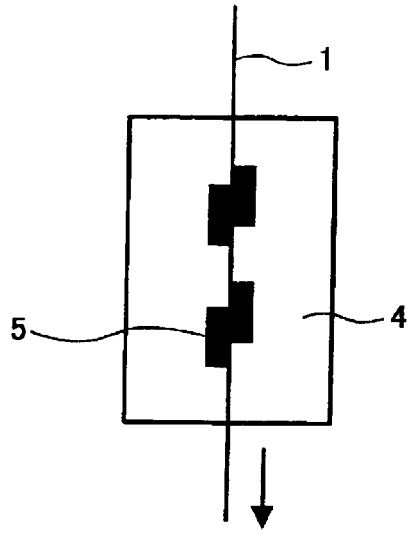
FIG. 1 is a schematic view illustrating an exemplary arrangement involving the non-contact fixing method using an oven, according to the present invention.

Generally, the present invention provides a toner having good fixability even in an image forming method using a non-contact fixing method. According to the present invention, the toner has a half melting temperature not greater than 115° C. In contrast to the present invention, when the half melting temperature is greater than 115° C., the fixability of the toner deteriorates.

In addition, when the half melting temperature of the toner is low, toner filming over an electrostatic latent-image bearer, a carrier and a developing sleeve tends to occur. In consideration of the toner filming, the half melting temperature of the toner is preferably from 90 to 115° C.

Further, when two or more toners having different colors are used, the toners preferably have a half melting temperature difference not greater than 10° C., particularly in an image forming method of reproducing multi-colored images combining plural layers of different-color toners. This is because mutual adherence of the toners has to be considered, in addition to fixability of the toner onto a receiving material, when two layers or more toners overlap. When toners have a half melting temperature difference not greater than 10° C., and preferably not greater than 7° C., the mutual adherence of the toners increases (separation of the toner layers is prevented) when fixed, and deterioration of the fixability and color reproducibility of the toner is prevented.

The "half melting temperature" measured by a flow tester in a preferred embodiment of the present invention may be the melting temperature measured by CFT-500C from Shimadzu Corp. in a 1/2 method. The half melting temperature is determined as follows:

(1) half of a difference between a flow completion point and the minimum value in a flow curve (piston stroke temperature) by a programmed temperature method is determined; and (2) the determined value plus the minimum value is determined as the half melting temperature.

The measuring conditions are as follows.

Cylinder pressure: 10.0 kgf/cm$^2$

Die; L: 1.0±0.005 mm

Die; D: 0.50±0.01 mm

Starting temperature: 50° C.

Programmed temperature: 3.0° C./min (1) 1.00±0.05 mg of a toner is pressurized by a flow tester granulator for a piston diameter 11.282+0.002/0 mm; and (2) a predetermined die is installed in the flow tester and the toner sample prepared in (1) is set therein, and the half melting temperature of the toner is measured on the above-mentioned conditions.

Toner having a glass transition point not less than 50° C., and preferably not less than 55° C. of the present invention, has good heat resistance without impairing fixability. Speaking only of heat resistance, higher glass transition points are preferable. However, when the glass transition point is high, the pulverizability of the toner deteriorates, and the glass transition point is preferably not greater than 68° C. in consideration of pulverizability. The glass transition point of the present invention may be measured by a measuring system from Rigaku Corp. (TG8110, TAS100 and DPS-8151). The measuring conditions are as follows.

Mode: TG-DTA

Reference: Al2O3

Measuring environment: Air (1) 10±2 mg of a toner is put in a sample container made of aluminum and an aluminum lid is crimped on the container;

(2) the sample is heated up to 160° C. at a programming rate of 10° C./min from room temperature, and left until the sample has returned to room temperature; and (3) the sample is heated up again to 160° C. at a programming rate of 10° C./min from room temperature, and a peak build-up temperature is read out using analysis software (DPS-8151 Ver. 2 from Rigaku Corp.)

The toner of the present invention preferably includes either a polyester resin or an epoxy resin. The polyester resin and epoxy resin are preferably used as a binder resin for a full-color toner because of better colorability (color reproducibility) than the other resins.

The polyester resin for use in the present invention is obtained from condensed polymerization of alcohol and a carboxylic acid. Specific examples of the alcohol include glycol such as ethyleneglycol, diethyleneglycol, triethyleneglycol and propyleneglycol; etherified bisphenol such as 1,4-bis(hydroxymethyl)cyclohexane and bisphenol A; units obtained form a dihydric alcohol monomer; and units obtained from a tri-or-more hydric alcohol monomer. Specific examples of the carboxylic acid include units obtained from a dihydric organic-acid monomer such as maleic acid, fumaric acid, phthalic acid, isophthalic acid, terephthalic acid, succinic acid and malonic acid; and units obtained from a tri-or-more hydric carboxylic-acid monomer such as 1,2,4-benzenetricarboxylic acid, 1,2,5-benzenetricarboxylic acid, 1,2,4-cyclohexanetricarboxylic acid, 1,2,4-naphthalanetricarboxylic acid, 1,2,5-hexanetricarboxylic acid, 1,3-dicarboxyl-2-methylenecarboxypropane and 1,2,7,8-octantetracarboxylic acid.

An epoxy resin preferred for use in the present invention is obtained from a condensed polymerization of bisphenol and epichlorohydrin. Specific examples of bisphenol include adducts of dihydric phenol with alkylene oxide, which are reaction products of ethylene oxide, propylene oxide, butylene oxide or their mixture and bisphenol A, bisphenol F, etc. This bisphenol is glycidylated with epichlorohydrin, β-methylepichlorohydrin, etc. to form an epoxy resin. Particularly, a glycidyl ether which is an adduct of bisphenol A with an alkylene oxide is preferably used.

Preferably, the toner of the present invention has a weight-average particle diameter not greater than 12 μm (micrometers). When greater than 12 μm, dot reproducibility, which is a feature of the non-contact heating fixation method, is noticeably impaired. Smaller weight-average particle diameter of the toner enables better the dot reproducibility and image resolution. However, the weight-average particle diameter of the toner is preferably from 5 to 10 μm in consideration of economical efficiency due to pulverizability of the toner.

The weight-average particle diameter of the toner of the present invention can be measured by various methods, and a Multisizer may be used. Namely, Coulter Multisizer model II from Beckman Coulter, Inc., with which an Interface from Nikkaki Bios Co., Ltd. and a personal computer are connected with is used, and an aqueous solution having 1% of NaCl is prepared as an electrolyte using a premier or a first class natrium chloride. The measurement is performed as follows:

(1) 0.1 to 5 ml of a detergent, or preferably alkyl benzene sulfonate is included as a disperser in the electrolyte having a volume of from 100 to 150 ml;

(2) 2 to 20 mg of a toner sample is included in the electrolyte to disperse the toner by an ultrasonic disperser for about from 1 to 3 min; and (3) the particle diameter of the toner sample is measured by the Multisizer II using an aperture having a diameter of 100 μm.

Volume and number of the toner are measured to determine a volume and number distribution. The weight-average particle diameter of the toner is determined from the volume distribution.

According to the present invention, a combination of a non-contact heating fixation method and a method of driving an electrostatic latent-image bearer by contacting a receiving material thereto, realize an image forming method capable of simultaneous duplex printing (or copying) with a simpler apparatus. In modem printing (copying) using an electrophotographic process, not only such high quality images as those of offset printing but also such a high-speed printing or copying as that of offset printing is required.

High-speed single sided printing has been improved to some extent, but high-speed duplex printing is still unsatisfactory. In particular, a method in which after a toner image is fixed on one side of a paper, another toner image is transferred and fixed on the other side thereof simply takes twice as much time as that of just single sided printing.

Then, methods in which after toner images are transferred onto both sides, the toner images are fixed thereon is investigated. Among the methods, a method in which electrostatic latent-image bearers are asymmetrically located on both sides of a receiving material such as a paper, and right after a toner image is transferred onto one side (surface) thereof, another toner image is transferred onto the other side (backside) thereof is investigated.

This method is classified into two methods based on different means to drive an electrostatic latent-image bearer. One is a method in which the electrostatic latent-image bearer is self-driven, having a rotating function such as a motor and a belt. The other is a method in which the electrostatic latent-image bearer is driven by contact with a receiving material such as paper.

The self-driven method has difficulty in controlling timing of duplex printing because of the rotating function. Therefore, precision and complexity of the apparatus is inevitable to control the timing precisely, resulting in cost increase and enlargement of the apparatus. In particular, in an apparatus producing multi-colored images, not only timing deviation of printing but also color deviation that is peculiar to the multi-colored images tends to occur. Therefore, workload on the apparatus controlling these deviations increases more than that of an apparatus producing only mono-color images.

The receiving material contact method drives an electrostatic latent-image bearer by contact with or an electrostatic force of a receiving material. Since the electrostatic latent-image bearer is driven in accordance with movement of the receiving material, it is easier to control timing of developing and transferring than it is in the self-driven method. Therefore, duplex printing timing and color deviations are not likely to occur, and the apparatus can be simplified.

FIG. 1 is a schematic view illustrating an exemplary embodiment of the non-contact fixing method using an oven, according to the present invention. In FIG. 1, numeral 1 is a receiving material such as paper, numeral 4 is an oven, and numeral 5 is a toner.

Figure 2:
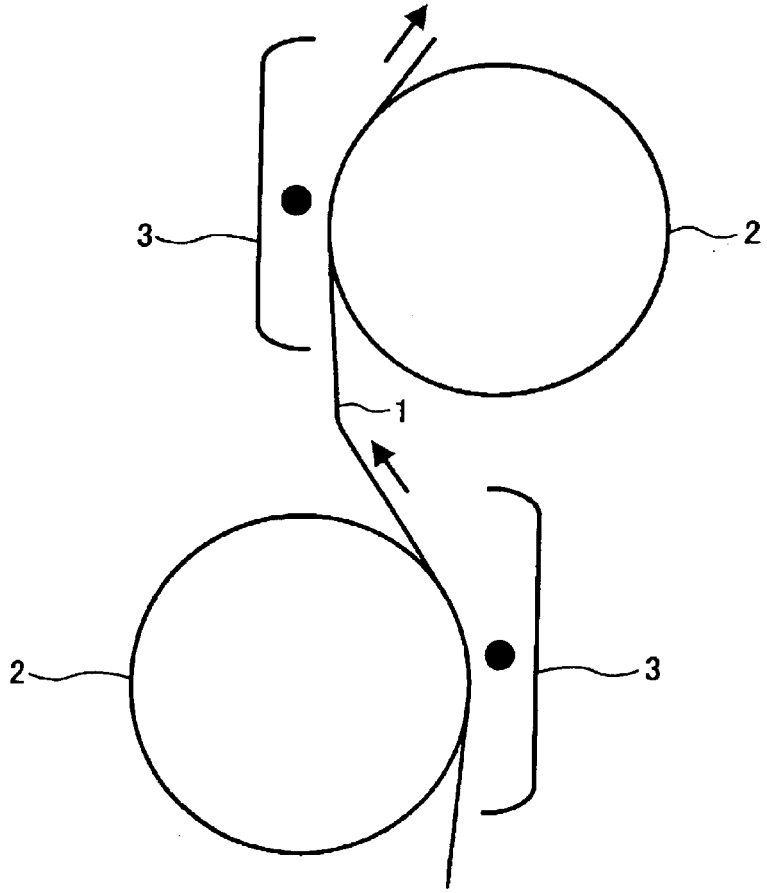
FIG. 2 is a schematic view illustrating an exemplary image forming method of the present invention, in which an electrostatic latent-image bearer is driven by contact of a receiving material.

FIG. 2 is a schematic view illustrating an image forming method of the present invention, in which an electrostatic latent-image bearer 2 is driven by a contact of a receiving material 1. In FIG. 2, numeral 3 is a transfer portion.

Receiving material 1 may be a material onto which a toner image is directly transferred from an electrostatic latent-image bearer, and is a medium on which the toner image is fixed. Specific examples of the receiving material include paper, an OHP (overhead projector) sheet, etc.

A binder resin other than polyester resin and epoxy resin can be used as the toner of the present invention.

Known resins can be used as the other binder resin as the toner of the present invention. Specific examples of the resin include styrene resins (styrene, or homopolymers or copolymers including a styrene substituent) such as styrene, poly-α-methylstyrene, styrene-chlorostyrene copolymers, styrene-propylene copolymers, styrene-butadiene copolymers, styrene-vinylchloride copolymers, styrene-vinylacetate copolymers, styrene-maleic acid copolymers, styrene-ester acrylate copolymers, styrene-methylacrylate copolymers, styrene-α-methylchloroacrylate copolymers and styrene-acrylonitrile-ester acrylate copolymers; vinylchloride resins; rosin-modified maleic acid resins; phenol resins; polyethylene resins; polypropylene resins; petroleum reins; polyurethane resins; ketone resins; ethylene-ethylacrylate copolymers, xylene resins; polyvinylbutyral resins, etc. These resins may be used together with polyester resin or epoxy resin, and can be used alone or in combination. In addition, the method of producing these resins is not limited, and any methods, such as mass polymerization, solution polymerization, emulsion polymerization and suspension polymerization, can be used.

As colorants for use in the present invention, known dyes and pigments can be used. Specific example of the colorant include carbon black, lamp black, nigrosin dyes, iron black, Naphthol yellow s, Hansa yellow (10G, 5G and G), Cadmium Yellow, yellow iron oxide, loess, chrome yellow, Titan yellow, polyazo yellow, Oil Yellow, Hansa Yellow (GR, A, RN and R), Pigment yellow L, Benzidine Yellow (G and GR), Permanent Yellow (NCG), Vulcan Fast Yellow (5G and R), Tartrazine Lake, Quinoline Yellow Lake, Anthrazane Yellow-BGL, isoindolinone yellow, colcothar, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent RedF5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chrome oxide, viridian, emerald green, pigment Green B, Naphthol Green B, Green Gold, Acid Green Lake, Malachite Green lake, Phthalocyanine green, Anthraquinone green, titanium oxide, Chinese white, lithopone and their mixtures. A content of the colorant is typically from 0.1 to 50 parts by weight per 100 parts by weight of the binder resin.

The toner of the present invention may optionally include a charge controlling agent. Known charge controlling agents can be used. Specific examples thereof include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, activators including fluorine, metal salts of salicylic acid, salicylic acid derivatives, etc.

Specific examples of the marketed products of the charge controlling agents include Bontron 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst A G; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group and a quaternary ammonium group.

Content of the charge controlling agent in the present invention depends on the type of the binder resin used, whether other additives are optionally used, and a method of producing the toner including the dispersion method. In general, the content is from 0.1 to 10 parts by weight, and preferably from 2 to 5 parts by weight per 100 parts by weight of the binder resin included in the toner. When less than 0.1 parts by weight, the resultant toner is short of chargeability and is not practical. When greater than 10 parts by weight, the resultant toner has such large chargeability that electrostatic attraction of the toner to the carrier and developing sleeve increases, resulting in deterioration of fluidity of the developer and image density of the resultant images.

The toner of the present invention may optionally include an additive such as silica fine particles, hydrophobic silica, fatty acid metal salts (zinc stearate, aluminum stearate, etc.), hydrophobic metal oxides (titania, alumina, tin oxide, antimony oxide, etc.) and fluoropolymers.

In particular, hydrophobized fine particles of the silica, titania and alumina are preferably used.

Any known hydrophobizing agents can be used in the present invention. Specific examples thereof include silane coupling agents such as hexamethyldisilazane and dimethyldichlorosilane, silane coupling agents including a nitrogen atom, silicone oil, etc.

Specific examples of the marketed products of the hydrophobizing agents include silica fine particles such as HDK H 2000, HDK H 2000/4, HDK H 2050EP and HVK21 (from Hoechst), R972, R974, RX200, RY200, R203, R805 and R812 (from Nippon Aerosil Co.); titania fine particles such as P-25 (from Nippon Aerosil Co.), Stt-30 and STT-65C-S (from Titan Kogyo KK), TAF-140 (from Fuji Titanium Industry Co., Ltd.), MT=150W, MT-500B and MT-600B (from Tayca Corp.); and fine particles of hydrophobized titanium oxide such as T-805 (from Nippon Aerosil Co.), STT-30A and STT-65S-S (from Titan Kogyo KK), TAF-500T and TAF-1500T (from Fuji Titanium Industry Co., Ltd.), MT-100S and MT-100T (from Tayca Corp.) and IT-S (from Ishihara Sangyo Kaisha, Ltd.).

Hydrophobicity for use in the present invention is preferably from 30 to 100. The hydrophobicity may be measured by a methanol titration test. A test method is as follows:

(1) 0.2 g of a hydrophobized fine particles is included in 50 ml of water in a beaker;

(2) methanol is dripped into the mixture until all the hydrophobized fine particles wet while stirring the mixture with a magnetic stirrer; and (3) the hydrophobicity is determined as a percentage of the methanol in the mixture when all the hydrophobized fine particles are wet.

In the present invention, an electrostatic latent image may be visualized by the so-called one-component developing method using only a toner or a two-component developing method using a carrier and a toner.

When the toner of the present invention is used in a two-component developer, the toner can be mixed with a magnetic carrier and the toner is preferably included in the two-component developer in an amount of from 1 to 10 parts by weight per 100 parts by weight of the carrier.

As the magnetic carriers, known carrier materials such as iron powders, ferrite powders, magnetite powders, magnetic resin carriers, which have a particle diameter of from 20 to 200 $\mu$m can be used. The surface of the carriers may be coated with a resin. Specific examples of such resins include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

In addition, an electroconductive powder may be optionally included in the toner. Specific examples of such electroconductive powders include metal powders, carbon blacks, titanium oxide, tin oxide, and zinc oxide. The average particle diameter of such electroconductive powders is preferably not greater than 1 $\mu$m. When the particle diameter is greater than 1 Mm, it is difficult to control the electric resistance of the resultant toner. A method of producing a toner of the present invention is, for example, as follows:

(1) the above-mentioned binder resin, pigment or dye as a colorant, charge controlling agent, lubricant and other additives are well mixed by a mixer such as a Henshel mixer;

(2) the resultant mixture is kneaded upon application of heat by a batch type two-roll mill, a Bumbury's mixer or a continuous biaxial extruder such as KTK biaxial extruder from Kobe Steel, Ltd., TEM biaxial extruder from Toshiba Machine Co., Ltd., PCM biaxial extruder from Ikegai Corporation and KEX biaxial extrude from Kurimoto, Ltd. and a continuous one-axis kneader such as KO-KNEADER from Buss AG and then cooled; and (3) the kneaded and cooled mixture is crushed by a hammer mill, etc.

In addition, a master batch that is prepared by kneading a part of a binder resin and a pigment upon application of heat is typically used as a colorant for color toner.

Further, the crushed mixture is pulverized by a jet stream pulverizer and/or a mechanical pulverizer, and the pulverized mixture is classified by a classifier using rotary stream or a classifier using Coanda effect to form a toner having a desired circularity and diameter.

An external and/or an internal additive may be used for the toner of the present invention. As an external additive mixer, a conventional powder mixer can be used. However, it is preferable that the mixer has a jacket and the internal temperature can be adjusted.

The external additive may be included in the mixer at a time in process of mixing or gradually included therein in order to change load level on the additive. As a matter of course, the rotational speed, nutation speed, mixing time or temperature of the mixer, may be changed. A large load at the beginning and small load next, or vice versa, may be applied to the additive.

Specific examples of the mixer include a V-form mixer, a locking mixer, a Loedge Mixer, a Nauter Mixers, a Henshel Mixer, a Super Mixer, etc.

In addition, inorganic fine particles may be included in the toner of the present invention as an internal additive. The internal additive may be included in the mixing process before the kneading process upon application of heat, or may be included in the kneading process with other toner components.

The toner and the developer of the present invention are filled in a container when they are used in an image forming apparatus, and generally the container filled with the toner is separately distributed and equipped with the apparatus by a user when using the apparatus to produce images. The above-mentioned container is not limited, and any containers can be used other than conventional bottles or cartridge type containers, or gazette packs for the developer.

When the color toner of the present invention is filled in a container such as a toner cartridge, adherence of the toner to the internal surface of the container is less than that of conventional toner, and the toner is smoothly and stably fed from the container.

Further, it is found that when the container collected from the market is recycled, the container is easily cleaned and handled.

In addition, it is also found that when the two-component developer, including the toner of the present invention and the carrier, is filled in a container such as a pack, adherence of the toner to the internal surface of the container is less than that of conventional developers, and toner scattering scarcely occurs. Therefore, the container is easily handled by a user or service man, and is easily disposed of as a separated refuse.

Having generally described exemplary embodiments of the invention, further understanding can be obtained by reference to certain specific examples that are provided herein for the purpose of illustration only, and that are not limiting.

EXAMPLES

In the descriptions in the following examples, the numbers represent weight ratios in parts, unless otherwise specified.

Toner Production Example 1.

Yellow Toner 1

The following materials were mixed and stirred in a flasher.

| | |
|---|---|
| Water | 600 |
| Pigment Yellow 17 aqueous cake (solid content of 50%) | 1200 |

Each 600 parts of a polyester resin having a number-average molecular weight (Mn) of 3,700 and an epoxy resin having a Mn of 3,500 were added to the mixture, and kneaded at 150° C. for 30 min. Then, 1,000 parts of xylene were added thereto, and further kneaded for 1 hr. After the water and xylene were removed therefrom, the residue was cooled by rolling and then pulverized by a pulverizer. Then, the powder was kneaded twice by a three-roll mill. Thus, a yellow master batch pigment was prepared.

Further, the following materials were mixed and the mixture was kneaded upon application of heat by a two-roll mill.

| | |
|---|---|
| Polyester resin (Mn: 3,700) | 50 |
| Epoxy resin (Mn: 3,500) | 50 |
| The above-mentioned yellow master batch | 5 |
| Zinc salycilate derivative (BONTRON E-84 from Orient Chemical Industries Co., Ltd.) | 4 |

The mixture was cooled by rolling and pulverized and air-classified to prepare a toner having a weight-average particle diameter of 7.8 μm. Further, 0.8% by weight of a hydrophobic silica (HDK H2000 from Hoechst, having a primary particle diameter of 20 nm) was mixed in the toner by a Henshel mixer to prepare a yellow toner 1.

Toner Production Example 2

Magenta Toner 1

The following materials were mixed and stirred in a flasher.

| | |
|---|---|
| Water | 600 |
| Pigment Red 57 aqueous cake (solid content of 50%) | 1200 |

Each 600 parts of a polyester resin having a number-average molecular weight (Mn) of 3,700 and an epoxy resin having a Mn of 3,500 were added to the mixture, and kneaded at 150° C. for 30 min. Then, 1,000 parts of xylene were added thereto, and further kneaded for 1 hr. After the water and xylene were removed therefrom, the residue was cooled by rolling and then pulverized by a pulverizer. Then, the powder was kneaded twice by a three-roll mill. Thus, a magenta master batch pigment was prepared.

Further, the following materials were mixed and the mixture was kneaded upon application of heat by a two-roll mill.

| | |
|---|---|
| Polyester resin (Mn: 3,700) | 50 |
| Epoxy resin (Mn: 3,500) | 50 |
| The above-mentioned yellow master batch | 5 |
| Zinc salycilate derivative (BONTRON E-84 from Orient Chemical Industries Co., Ltd.) | 4 |

The mixture was cooled by rolling and pulverized and air-classified to prepare a toner having a weight-average particle diameter of 7.8 μm. Further, the same additive as that of the above-mentioned yellow toner 1 was mixed in the toner by a Henshel mixer to prepare a magenta toner 1.

Toner Production Example 3

Cyan Toner 1

The following materials were mixed and stirred in a flasher.

| | |
|---|---|
| Water | 600 |
| Pigment Blue 15:3 aqueous cake (solid content of 50%) | 1200 |

Each 600 parts of a polyester resin having a number-average molecular weight (Mn) of 3,700 and an epoxy resin having a Mn of 3,500 were added to the mixture, and kneaded at 150° C. for 30 min. Then, 1,000 parts of xylene were added thereto, and further kneaded for 1 hr. After the water and xylene were removed therefrom, the residue was cooled by rolling and then pulverized by a pulverizer. Then, the powder was kneaded twice by a three-roll mill. Thus, a cyan master batch pigment was prepared.

Further, the following materials were mixed and the mixture was kneaded upon application of heat by a two-roll mill.

| | |
|---|---|
| Polyester resin (Mn: 3,700) | 50 |
| Epoxy resin (Mn: 3,500) | 50 |
| The above-mentioned yellow master batch | 3 |
| Zinc salycilate derivative (BONTRON E-84 from Orient Chemical Industries Co., Ltd.) | 4 |

The mixture was cooled by rolling and pulverized and air-classified to prepare a toner having a weight-average particle diameter of 7.8 μm. Further, the same additive as that of the above-mentioned yellow toner 1 was mixed in the toner by a Henshel mixer to prepare a cyan toner 1.

Toner Production Example 4

Black Toner 1

The following materials were mixed and stirred in a flasher.

| | |
|---|---|
| Water | 1200 |
| Phthalocyanine green aqueous cake (solid content of 30%) | 200 |
| Carbon black (MA60 from Mitsubishi Chemical Corp.) | 540 |

Each 600 parts of a polyester resin having a number-average molecular weight (Mn) of 3,700 and an epoxy resin having a Mn of 3,500 were added to the mixture, and kneaded at 150° C. for 30 min. Then, 1,000 parts of xylene were added thereto, and further kneaded for 1 hr. After the water and xylene were removed therefrom, the residue was cooled by rolling and then pulverized by a pulverizer. Then, the powder was kneaded twice by a three-roll mill. Thus, a black master batch pigment was prepared.

Further, the following materials were mixed and the mixture was kneaded upon application of heat by a two-roll mill.

| | |
|---|---|
| Polyester resin (Mn: 3,700) | 50 |
| Epoxy resin (Mn: 3,500) | 50 |
| The above-mentioned yellow master batch | 5 |
| Zinc salycilate derivative (BONTRON E-84 from Orient Chemical Industries Co., Ltd.) | 4 |

The mixture was cooled by rolling and pulverized and air-classified to prepare a toner having a weight-average particle diameter of 7.8 μm. Further, the same additive as that of the above-mentioned yellow toner 1 was mixed in the toner by a Henshel mixer to prepare a black toner 1.

Toner Production Example 5

Yellow Toner 2

The procedures of preparation for the yellow toner 1 in Toner Production Example 1 were repeated to prepare a yellow toner 2, except for using only the polyester resin instead of using both the polyester and epoxy resins.

Toner Production Example 6

Magenta Toner 2

The procedures of preparation for the magenta toner 1 in Toner Production Example 2 were repeated to prepare a magenta toner 2, except for using only the polyester resin instead of using both the polyester and epoxy resins.

Toner Production Example 7

Yellow Toner 3

The procedures of preparation for the yellow toner 1 in Toner Production Example 1 were repeated to prepare a yellow toner 2, except for using only the epoxy resin instead of using both the polyester and epoxy resins.

Toner Production Example 8

Magenta Toner 3

The procedures of preparation for the magenta toner 1 in Toner Production Example 2 were repeated to prepare a magenta toner 3, except for using only the epoxy resin instead of using both the polyester and epoxy resins.

Toner Production Example 9

Yellow Toner 4

The procedures of preparation for the yellow toner 1 in Toner Production Example 1 were repeated to prepare a yellow toner 4, except for using each 50 parts by weight of a styrene-methylacrylate resin and a styrene-n-butylacrylate resin instead of using the polyester and epoxy resins.

Toner Production Example 10

Magenta Toner 4

The procedures of preparation for the magenta toner 1 in Toner Production Example 2 were repeated to prepare a magenta toner 4, except for using each 50 parts by weight of a styrene-methylacrylate resin and a styrene-n-butylacrylate resin instead of using the polyester and epoxy resins.

Toner Production Example 11

Yellow Toner 5

The procedures of preparation for the yellow toner 4 in Toner Production Example 9 were repeated to prepare a yellow toner 5, except for changing the weight-average particle diameter into 13.2 μm.

Toner Production Example 12

Yellow Toner 6

The procedures of preparation for the yellow toner 1 in Toner Production Example 1 were repeated to prepare a yellow toner 6, except for using 90 parts by weight of a styrene-methylacrylate resin and 10 parts by weight of a styrene-n-butylacrylate resin instead of using the polyester and epoxy resins.

Toner Production Example 13

Yellow Toner 7

The procedures of preparation for the yellow toner 1 in Toner Production Example 1 were repeated to prepare a yellow toner 7, except for using 30 parts by weight of a styrene resin and 70 parts by weight of a styrene-2-ethylhexylacrylate resin instead of using the polyester and epoxy resins.

Toner Production Example 14

Yellow Toner 8

The procedures of preparation for the yellow toner 1 in Toner Production Example 1 were repeated to prepare a yellow toner 6, except for using 20 parts by weight of a styrene-methylacrylate resin and 80 parts by weight of a styrene-n-butylacrylate resin instead of using the polyester and epoxy resins.

Carrier Production Example

The following materials were mixed by a homomixer for 30 min to prepare a coated layer forming liquid:

| | |
|---|---|
| Silicone resin liquid solution (KR50 from Shin-Etsu Chemical Co., Ltd.) | 100 |
| γ-(2-aminoethyl)aminopropyltrimethoxysilane | 3 |
| Toluene | 100 |

The liquid is coated on 1,000 parts by weight of a spherical ferrite having an average particle diameter of 50 μm (microns) by a fluidized bed coater to prepare a carrier A.

Developer Production Examples 1 to 14

Each 100 g of the toners of Toner production Examples 1 to 14 and 1.9 kg of the carrier A were mixed and stirred in a ball mill for 30 min to prepare developers 1 to 14.

Example 1

In examples of the present invention, more severe conditions of evaluation, (such as a larger amount of adhered toner, lower fixing temperature, higher fixing speed including duplex printing) were applied than conventional, in order to maximize the distinction of the present invention.

A single-sided unfixed toner image and a double-sided unfixed toner image were produced with the toner prepared in Toner Production Example 1 such that the toner had an adhered amount of 1.0±0.5 mg/cm$^2$. The single-sided unfixed toner image was fixed by the non-contact fixer used in Japanese Laid-Open Patent Publication No. 2000-39794 at 100° C. The double-sided unfixed toner image was fixed by the non-contact fixer shown in FIG. 1. Then, mending tape (from 3M) was adhered onto the fixed toner images and slowly peeled off after a specified pressure was applied thereto to evaluate fixability of the toner images. The fixing speed was 220 mm/sec in both the single-sided and double-sided fixers.

When the double-sided non-contact fixer shown in FIG. 1 was used only for fixing a single-sided toner image, performance thereof was the same as that the single-sided non-contact fixer used in Japanese Laid-Open Patent Publication No. 2000-39794 if the fixing temperature and speed are same.

An image was produced by a copier DCP320D from XEIKON NV using the toner prepared in Toner Production Example 1 and the developer prepared in Developer Production Example 1 to evaluate dot reproducibility of the image. Further, 100 k images were produced to evaluate the toner filming over the photoreceptor. In addition, the toner prepared in Toner Production Example 1 was left in an environmental testing room having a temperature of 50° C. for 24 hrs to evaluate heat resistance (solidification) of the toner.

The fixability (onto paper) and dot reproducibility were visually evaluated and the results are shown in Table 1. The results were graded into the following five ranks:

5: Very good

4: Good

3: Acceptable

2: Poor

1: very poor

Example 2

The procedures of evaluation for the toner and developer in Example 1 were repeated except for using the toner and developer, respectively prepared in Toner Production Example 2 and Developer Production Example 2. The results are shown in Table 1.

Example 3

The procedures of evaluation for the toner and developer in Example 1 were repeated except for using the toner and developer, respectively prepared in Toner Production Example 3 and Developer Production Example 3. The results are shown in Table 1.

Example 4

The procedures of evaluation for the toner and developer in Example 1 were repeated except for using the toner and developer, respectively prepared in Toner Production Example 4 and Developer Production Example 4. The results are shown in Table 1.

Example 5

The procedures of evaluation for the toner and developer in Example 1 were repeated except for using the toner and developer, respectively prepared in Toner Production Example 5 and Developer Production Example 5. The results are shown in Table 1.

Example 6

The procedures of evaluation for the toner and developer in Example 1 were repeated except for using the toner and developer, respectively prepared in Toner Production Example 6 and Developer Production Example 6. The results are shown in Table 1.

Example 7

The procedures of evaluation for the toner and developer in Example 1 were repeated except for using the toner and developer, respectively prepared in Toner Production Example 7 and Developer Production Example 7. The results are shown in Table 1.

Example 8

The procedures of evaluation for the toner and developer in Example 1 were repeated except for using the toner and developer, respectively prepared in Toner Production Example 8 and Developer Production Example 8. The results are shown in Table 1.

Example 9

The procedures of evaluation for the toner and developer in Example 1 were repeated except for using the toner and developer, respectively prepared in Toner Production Example 9 and Developer Production Example 9. The results are shown in Table 1.

Example 10

The procedures of evaluation for the toner and developer in Example 1 were repeated except for using the toner and developer, respectively prepared in Toner Production Example 10 and Developer Production Example 10. The results are shown in Table 1.

Example 11

The procedures of evaluation for the toner and developer in Example 1 were repeated except for using the toner and developer, respectively prepared in Toner Production Example 11 and Developer Production Example 11. The results are shown in Table 1.

Example 12

The procedures of evaluation for the toner and developer in Example 1 were repeated except for using the toner and developer, respectively prepared in Toner Production Example 12 and Developer Production Example 12. The results are shown in Table 1.

Example 13

The procedures of evaluation for the toner and developer in Example 1 were repeated except for using the toner and developer, respectively prepared in Toner Production Example 13 and Developer Production Example 13. The results are shown in Table 1.

Comparative Example 1

The procedures of evaluation for the toner and developer in Example 1 were repeated except for using the toner and developer, respectively prepared in Toner Production Example 14 and Developer Production Example 14. The results are shown in Table 1.

TABLE 1

| Ex. | Prod.Ex. | A | B | C | D | E | F | G | H |
|---|---|---|---|---|---|---|---|---|---|
| 1 | 1 | 106 | 58 | 7.8 | 5 | 5 | N.S. | No | 5 |
| 2 | 2 | 105 | 58 | 7.8 | 5 | 5 | N.S. | No | 5 |
| 3 | 3 | 105 | 58 | 7.8 | 5 | 5 | N.S. | No | 5 |
| 4 | 4 | 106 | 58 | 7.8 | 5 | 5 | N.S. | No | 5 |
| 5 | 5 | 113 | 60 | 7.8 | 5 | 4 | N.S. | No | 5 |
| 6 | 6 | 113 | 60 | 7.8 | 5 | 4 | N.S. | No | 5 |
| 7 | 7 | 100 | 56 | 7.8 | 5 | 5 | N.S. | No | 5 |
| 8 | 8 | 100 | 56 | 7.8 | 5 | 5 | N.S. | No | 5 |
| 9 | 9 | 106 | 58 | 7.8 | 5 | 5 | N.S. | No | 5 |
| 10 | 10 | 105 | 58 | 7.8 | 5 | 5 | N.S. | No | 5 |
| 11 | 11 | 105 | 58 | 13.2 | 5 | 5 | N.S. | No | 3 |
| 12 | 12 | 85 | 56 | 7.8 | 5 | 5 | N.S. | Yes | — |
| 13 | 13 | 100 | 45 | 7.8 | 5 | 5 | Solidified | No | 5 |
| C.E. 1 | 14 | 120 | 61 | 7.8 | 2 | 1 | N.S. | No | 5 |

A: 1/2 melting temperature
B: Glass transition point
C: Weight-average particle diameter
D: Single-sided image fixability (onto a paper)
E: Double-sided image fixability (onto a paper)
F: Heat resistance
G: Filming
H: Dot reproducibility
"C.E. 1": "Comparative example 1"
"N.S.": "Not solidified"

Example 14

A single-sided unfixed toner image and a double-sided unfixed toner image were produced, using the toners prepared in Toner Production Example 1 and Toner Production Example 2 so as to form two layers of each toner having an adhered amount of 1.0±0.5 mg/cm$^2$ respectively. The single-sided and double-sided unfixed toner images were fixed by the same method in Example 1 to evaluate color reproducibility of the images.

Fixed toner images for fixability (between each toner) evaluation were produced by the same method as that of the evaluation for the color reproducibility. Further, a mending tape (from 3M) was adhered onto the fixed toner images and slowly peeled off after a specified pressure was applied thereto to evaluate fixability of the toner.

When the double-sided non-contact fixer shown in FIG. 1 was used only for fixing a single-sided toner image, performance thereof was the same as that the single-sided non-contact fixer used in Japanese Laid-Open Patent Publication No. 2000-39794 if the fixing temperature and speed are same.

The fixability (between each toner) and color reproducibility were visually evaluated and the results are shown in Table 2. The results were graded into the following five ranks:

5: Very good
4: Good
3: Acceptable
2: Poor
1: very poor

Example 15

The procedures of evaluation for the toner in Example 14 were repeated except for changing the toner prepared in Toner Production Example 2 into the toner prepared in Toner Production Example 8. The results are shown in Table 2.

Example 16

The procedures of evaluation for the toner in Example 15 were repeated except for changing the toner prepared in Toner Production Example 1 into the toner prepared in Toner Production Example 5. The results are shown in Table 2.

Example 17

The procedures of evaluation for the toner in Example 16 were repeated except for changing the toners prepared in Toner Production Example 5 and Toner Production Example 8 into the toners prepared in Toner Production Example 9 and Toner Production Example 10. The results are shown in Table 2.

TABLE 2

| Example | Prod Ex | I | J | L | L | M | N |
|---|---|---|---|---|---|---|---|
| 14 | 1 | 106 | 1 | 5 | 5 | 5 | 5 |
| | 2 | 105 | | | | | |
| 15 | 1 | 106 | 6 | 5 | 5 | 5 | 5 |
| | 8 | 100 | | | | | |
| 16 | 5 | 113 | 13 | 4 | 4 | 5 | 4 |
| | 8 | 100 | | | | | |
| 17 | 9 | 106 | 1 | 5 | 5 | 5 | 4 |
| | 10 | 105 | | | | | |

I: 1/2 melting temperature
J: difference of 1/2 melting temperature
K: Single-sided image fixability (to the other toner)
L: Double-sided image fixability (to the other toner)
M: Single-sided image color reproducibility
N: Double-sided image color reproducibility This document claims priority and contains subject matter related to Japanese Patent Application No. 2001-290393 filed on Sep. 25, 2001, which is incorporated herein by reference.

Having now fully described embodiments of the invention, it will be apparent to one of ordinary skill in the art that many changes and modifications can be made thereto without departing from the spirit and scope of the invention as set forth therein.

What is claimed is:

1. An image forming method comprising:

charging an electrostatic latent image bearer;

irradiating the electrostatic latent image bearer with light to form an electrostatic latent image on the electrostatic latent image bearer;

developing the electrostatic latent image with two developers to form a toner image on the electrostatic latent image bearer;

transferring the toner image onto a receiving material; and fixing the toner image on the receiving material by a non-contact fixing method, wherein each of the two developers has a half melting temperature not greater than 115° C. and a difference between the half melting temperatures of the two developers is not greater than 10° C.

2. The image forming method according to claim 1, wherein at least one of the developers has the half melting temperature between 90 and 115° C.

3. The image forming method according to claim 1, wherein at least one of the developers has a glass transition point not less than 50° C.

4. The image forming method according to claim 1, wherein at least one of the developers has a weight-average particle diameter of not greater than 12 $\mu$m.

5. The image forming method according to claim 1, wherein at least one of the developers comprises a particulate magnetic carrier.

6. The image forming method according to claim 1, further comprising:

driving the electrostatic latent image bearer with the receiving material.

7. The image forming method according to claim 1, wherein the difference between the half melting temperatures is not greater than 7° C.

8. An image forming method comprising:

forming an image with two developers having half melting temperatures not greater than 115° C. and a difference between the half melting temperatures not greater than 10° C.

9. The image forming method according to claim 8, wherein at least one of the developers has the half melting temperature between 90 and 115° C.

10. The image forming method according to claim 8, wherein at least one of the developers has a glass transition point not less than 50° C.

11. The image forming method according to claim 8, wherein at least one of the developers has a weight-average particle diameter of not greater than 12 $\mu$m.

12. The image forming method according to claim 8, wherein at least one of the developers comprises a particulate magnetic carrier.

13. The image forming method according to claim 8, wherein the difference between the half melting temperatures is not greater than 7° C.

* * * * *